US007921783B2

(12) United States Patent
Forbes et al.

(10) Patent No.: US 7,921,783 B2
(45) Date of Patent: Apr. 12, 2011

(54) HOPPER CAR WITH LADING DISLODGEMENT FITTINGS AND METHOD OF OPERATION

(75) Inventors: James W. Forbes, Campbellville, CA (US); Tomasz Bis, Ancaster, CA (US)

(73) Assignee: National Steel Car Limited (CA)

( * ) Notice: Subject to any disclaimer, the term of this patent is extended or adjusted under 35 U.S.C. 154(b) by 324 days.

(21) Appl. No.: 12/047,838

(22) Filed: Mar. 13, 2008

(65) Prior Publication Data

US 2008/0223252 A1 Sep. 18, 2008

Related U.S. Application Data

(60) Provisional application No. 60/895,319, filed on Mar. 16, 2007.

(51) Int. Cl.
*B61D 7/18* (2006.01)
*B61D 7/32* (2006.01)

(52) U.S. Cl. ..... 105/247; 105/250; 105/280

(58) Field of Classification Search ..... 105/247, 105/248, 250, 253, 280, 283, 284, 286, 288, 105/289, 290; 222/226, 227, 229, 459; 298/27, 298/28, 29

See application file for complete search history.

(56) References Cited

U.S. PATENT DOCUMENTS

| | | | | | |
|---|---|---|---|---|---|
| 1,910,583 | A * | 5/1933 | Wine | ..... | 105/280 |
| 3,997,089 | A * | 12/1976 | Clarke et al. | ..... | 222/545 |
| 4,366,757 | A * | 1/1983 | Funk | ..... | 105/248 |
| 4,574,989 | A * | 3/1986 | Pole | ..... | 222/486 |
| 6,067,912 | A * | 5/2000 | Miller | ..... | 105/283 |
| 2009/0302065 | A1 * | 12/2009 | Winsor | ..... | 222/236 |

* cited by examiner

*Primary Examiner* — S. Joseph Morano
*Assistant Examiner* — Zachary Kuhfuss
(74) *Attorney, Agent, or Firm* — Hahn Loeser & Parks LLP; Michael H. Minns

(57) ABSTRACT

A hopper car discharge section may be wide at the top and narrow at the bottom. Outflow is controlled by closure members, at least one of which is movable. The closure members come together to a closed condition or position for retaining lading. When apart, in an open position or condition, lading may be discharged. A seal member or seal member assembly is mounted to one or both of the closure members. The closure member may have a lading discharge encouragement feature, which may be in the nature of a tine, or blade, or knife that extends upwardly through the throat of the discharge section. Movement of the door may tend to move the blade, thereby tending to dislodge lading that may be otherwise reluctant to move.

18 Claims, 12 Drawing Sheets

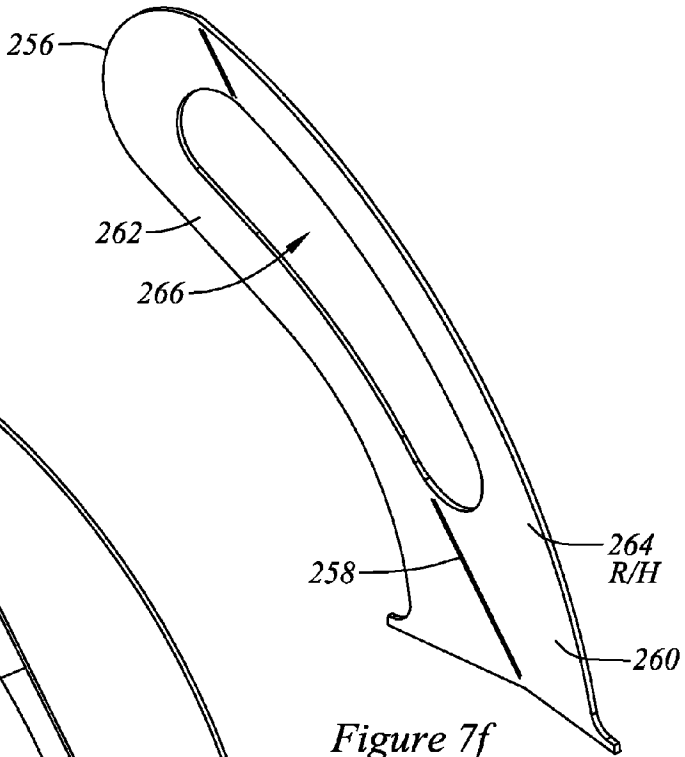
Figure 7f
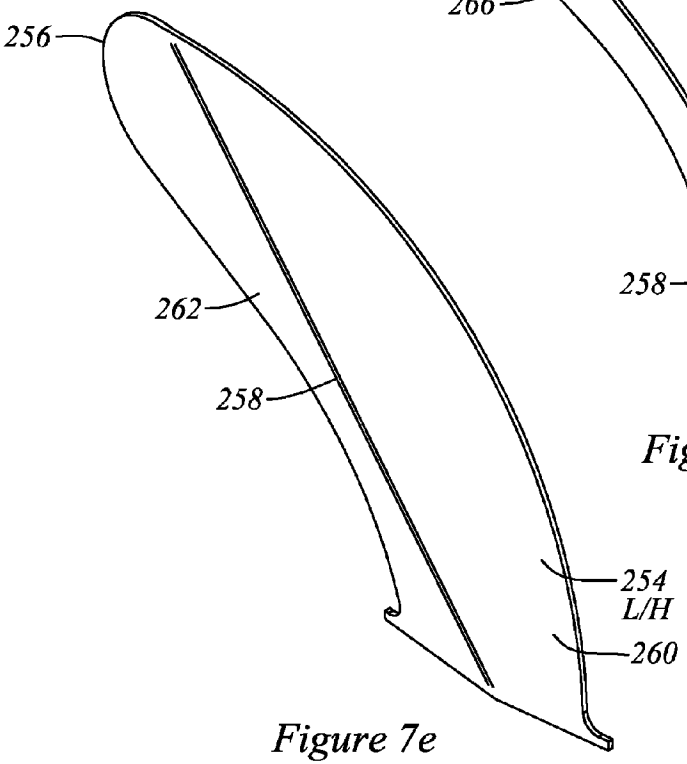
Figure 7e
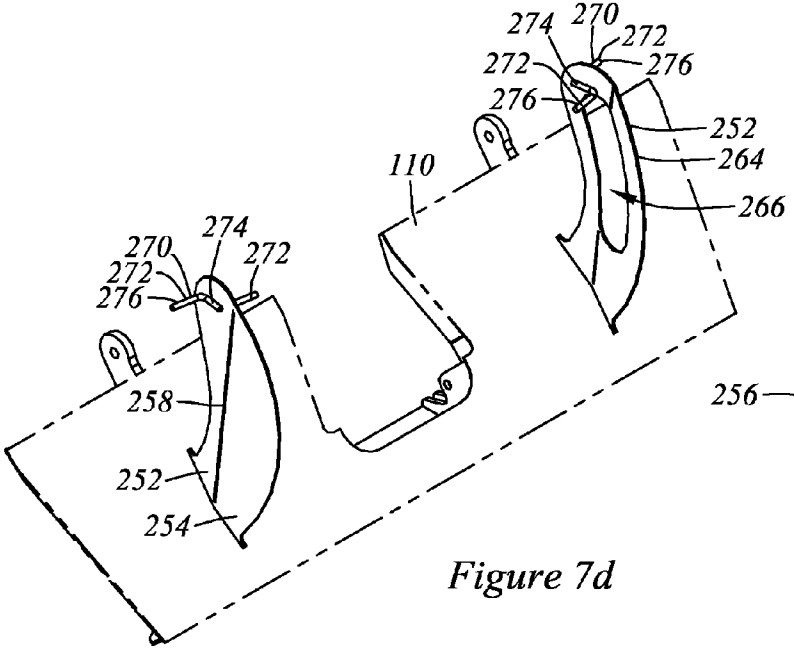
Figure 7d
Figure 7h
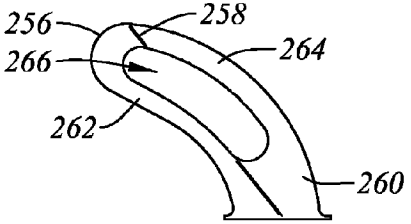
Figure 7g

HOPPER CAR WITH LADING DISLODGEMENT FITTINGS AND METHOD OF OPERATION

This application claims the benefit of the priority of U.S. Provisional Application No. 60/895,319, filed Mar. 16, 2007. The subject matter of U.S. Provisional Application No. 60/895,319 is incorporated herein by reference.

FIELD OF THE INVENTION

This invention relates to the field of rail road freight cars, and, in particular to rail road freight cars such as may employ bottom unloading gates.

BACKGROUND

There are many kinds of rail road cars for carrying particulate material, be it sand or gravel aggregate, plastic pellets, grains, ores, potash, coal or other granular materials. These materials are not liquid, yet may in some ways tend to flow in a somewhat liquid-like manner. Many of those cars have an upper opening, or accessway of some kind, by which the particulate is loaded, and a lower opening, or accessway, or gate, by which the particulate material exits the car under the influence of gravity. Clearly, while the inlet opening need not necessarily have a movable gate (but may include a cover to discourage contamination of the lading or exposure of the lading to the wind), the outlet opening requires a governor of some kind that is movable between a closed position for retaining the lading while the lading is being transported, and an open position for releasing the lading at the destination. The terminology "flow through" or "flow through rail road car" or "center flow" car, or the like, may sometimes be used for cars of this nature where lading is introduced at the top, and flows out at the bottom.

Consider, for example, a hopper car for transporting aggregate, be it gravel or sand. The hopper may have a converging hopper discharge section that has the shape, generally speaking, of an inverted four sided, truncated pyramid. At the bottom of this discharge section is a door, or gate for releasing the aggregate at the destination. On occasion, moist fine aggregate, which may be sand, may have an inconvenient tendency to bridge and stick in the discharge. This may delay the unloading of the car, or require the use of shaking equipment or hammers. It may be helpful to discourage, or break up such bridging in the lading.

SUMMARY OF THE INVENTION

In an aspect of the invention there is a door assembly for a railroad car hopper discharge. The door assembly has a door panel, a hinge connection by which to mount the door assembly to the railroad car, and a protruding member. The door panel is movable to a closed position relative to the hopper discharge to obstruct egress of lading from the hopper discharge. The door panel has an inside and an outside. The protruding member is mounted to the inside of the door panel, and the protruding member extends upwardly of the hinge connection when the door panel is mounted to the hopper car.

In yet another aspect of the invention, there is a rail road hopper car having a receptacle for lading carried by rail road car trucks. The receptacle for lading has at least one hopper discharge. The receptacle for lading has a depth Z. The discharge has a throat, and the throat has an hydraulic diameter, $D_H$. Z is greater in magnitude than $D_H$. Egress of lading from the discharge outlet is controlled by a door. The door has a door panel movable to a closed position to obstruct passage of lading through the discharge. The door has a lading dislodgement apparatus mounted thereto. In the closed position of the door the lading discharge apparatus extends upwardly and away from the door panel beyond the throat.

In a feature of that aspect of the invention, the dislodgement apparatus is a member mounted substantially perpendicularly to the door panel. In another feature, the dislodgement apparatus has an end distant from the door panel, and the distant end has a pointed tip. In a further feature, a cross-wise member is mounted at the distant end of the dislodgement apparatus. In still another feature, the cross-wise member includes at least one tine. In yet another feature, the cross-wise member is a plate. In another feature, the dislodgement apparatus had an end distant from the door panel, and the distant end has an array of fingers mounted thereto.

In yet still another feature of that aspect of the invention, in the closed position of the door, the lading dislodgement apparatus extends upwardly beyond the throat a distance greater than one half of the hydraulic diameter. In a further feature, the lading dislodgement apparatus extends a distance greater than ¾ of the hydraulic diameter upwardly beyond the throat. In another feature, the door panel mates with a stationary opening, the stationary opening has side edges, each side edge having a length; and the lading dislodgement apparatus has a distal portion extending a distance away from the door panel, the distance having a greater magnitude than the side edge length.

In another aspect of the invention there is a railroad hopper car. It has a car body carried on trucks for rolling motion along railroad tracks. The car body includes an upstanding peripheral wall structure for containing particulate lading, and a straight through center sill. The car body has at least a first hopper and a second hopper. Each of the first and second hoppers has first and second sloped side sheets and first and second sloped end sheets co-operably mounted to define an inverted truncated pyramidal funnel. At least said first hopper has twin first and second discharge sections lying to each side of the center sill. Each discharge section has a throat and a respective door. The respective discharge doors are yoked together for common movement, and are operable to move between open and closed positions to govern discharge of particulate lading from the first hopper. The discharge section has a throat. Each of the discharge doors has a movable door panel, and a protruding lading dislodgement prong member mounted to the door panel. The prong member extends generally upwardly of the door panel and inwardly relative to the first hopper. When the doors are in their respective closed positions, each prong member has an uppermost extremity, the uppermost extremity being located at a height corresponding to that of the throat.

In another feature of that aspect of the invention, the lading dislodgement prong member has a cross-wise member mounted at the uppermost extremity. In still another feature, the center sill includes an upper flange and a lower flange, and, when its respective door is in the closed position, the upper extremity of the lading dislodgement prong member is located at a height that corresponds to that of the upper flange of the center sill. In yet another feature, the prong member includes a substantially planar member extending away from the door panel, and an out-of-plane member mounted at the uppermost extremity.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which:

FIG. 7*d* is an isometric view of the assembly of FIG. 7*a* showing two alternate embodiments of the lading dislodgement apparatus of FIG. 7*a;*

FIG. 7*e* is an isometric view of a first of the embodiments of FIG. 7*d;*

FIG. 7*f* is an isometric view of a second of the embodiments of FIG. 7*d;*

FIG. 7*g* is a side view of the embodiment of FIG. 7*f*; and

FIG. 7*h* is an end view of the embodiment of FIG. 7*f.*

DETAILED DESCRIPTION

Figure 1A:
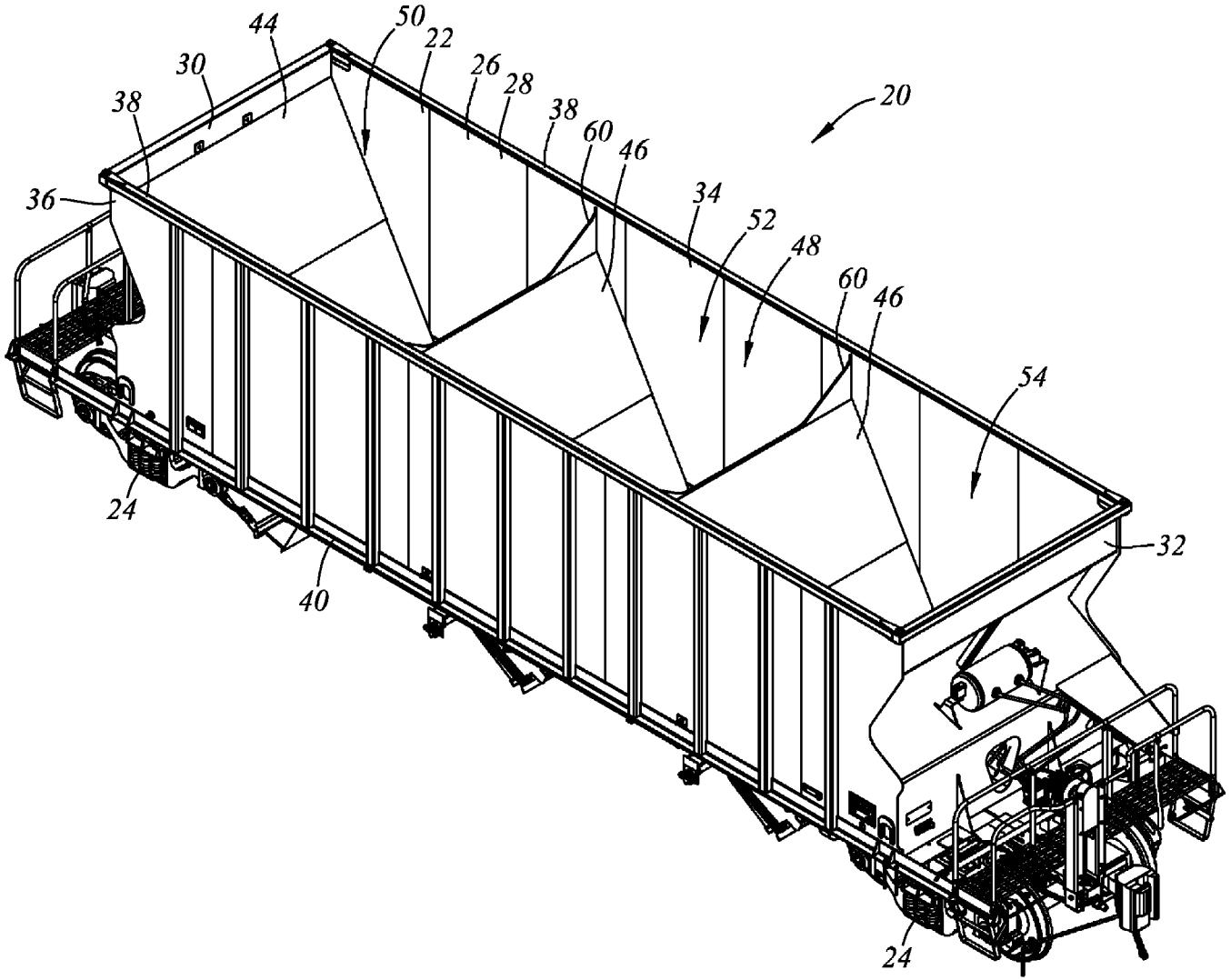
FIG. 1*a* is a general arrangement, isometric view of a rail road freight car.

The apparatus described herein may be used in conjunction with rail road aggregate hopper cars, including those embodiments of hopper cars shown or described (or shown and described) in co-pending U.S. patent application Ser. No. 11/530,334 entitled "Rail Road Hopper Car Fittings and Method of Operation" filed Sep. 8, 2006,the specification of which is incorporated herein by reference.

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings are generally to scale unless noted otherwise.

The terminology used in this specification is thought to be consistent with the customary and ordinary meanings of those terms as they would be understood by a person of ordinary skill in the rail road industry in North America. Following from decision of the CAFC in *Phillips* v. *AWH Corp.*, the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with *In re Lee*, (for example, earlier publications by persons not employed by the USPTO or any other Patent Office), demonstrating how the terms are used and understood by persons of ordinary skill in the art, or by way of expert evidence of a person or persons of at least 10 years experience in the rail road industry in North America or in other territories or former territories of the British Empire and Commonwealth.

In terms of general orientation and directional nomenclature, for rail road cars described herein the longitudinal direction is defined as being coincident with the rolling direction of the rail road car, or rail road car unit, when located on tangent (that is, straight) track. In the case of a rail road car having a center sill, the longitudinal direction is parallel to the center sill, and parallel to the top chords. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the rail road car described herein may tend to have both longitudinal and transverse axes of symmetry, a description of one half of the car may generally also be intended to describe the other half as well, allowing for differences between right hand and left hand parts. In this description, the abbreviation kpsi stands for thousand of pounds per square inch. To the extent that this specification or the accompanying illustrations may refer to standards of the Association of American Railroads (AAR), such as to AAR plate sizes, those references are to be understood as at the earliest date of priority to which this application is entitled.

FIG. 1*a* shows an isometric view of an example of a rail road freight car 20 that is intended to be representative of a wide range of rail road cars in which the present invention may be incorporated. While car 20 may be suitable for a variety of general purpose uses, it may be taken as being symbolic of, and in some ways a generic example of, a flow through car, in which lading is introduced by gravity flow from above, and removed by gravity discharge through gated or valved outlets below. Flow through, or center flow cars may include open topped hopper cars, grain cars, plastic pellet cars, potash cars, ore cars, and so on. In one embodiment car 20 may be a hopper car such as may be used for the carriage of bulk commodities in the form of a granular particulate, be it in the nature of relatively coarse gravel or fine aggregate in the nature of fine gravel or sand or various ores or concentrate or coal. Car 20 may be symmetrical about both its longitudinal and transverse, or lateral, centerline axes. Consequently, it will be understood that the car has first and second, left and right hand side beams, bolsters and so on. In one embodiment, the granular particulate may be sand, and, depending on its condition when loaded, or if the hopper is uncovered during rain or snowfall, the particulate may be moist to a greater or lesser extent.

By way of a general overview, car 20 may have a car body 22 that is carried on trucks 24 for rolling operation along railroad tracks. Car 20 may be a single unit car, or it may be a multi-unit car having two or more car body units, where the multiple car body units may be connected at an articulated connector, or by draw bars. Car body 22 may have a lading containment vessel or shell 26 such as may include an upstanding wall structure 28 which may have a pair of opposed first and second end walls 30, 32, that extend crosswise, and a pair of first and second side walls 34, 36 that extend lengthwise, the end walls 30, 32 and side walls 34, 36 co-operating to define a generally rectangular form of peripheral wall structure 28. Wall structure 28 may include top chords 38 running along the top of the walls, and side sills 40 running fore-and-aft along lower portions of the side sheets of side walls 34, 36. In some instances car 20 may have stub center sills at either end, in which case side walls 34, 36 may act as deep beams, and may carry vertical loads to main bolsters that extend laterally from the centerplates. Alternatively, or in addition to deep side beams, car 20 may include a center sill 42, which may be a straight-through center sill, running from one end of the car body to the other. In the case of a single, stand alone car unit, draft gear and releaseable couplers may be mounted at either end of the center sill. In a center flow, or flow through car, the upper portion of the car may typically include means by which to admit lading under a gravity drop system. Such an intake, or entryway may be a large rectangular opening such as bounded by top chords 38, or the car may have one or more hatches, whether covered or uncovered.

Figure 1C:
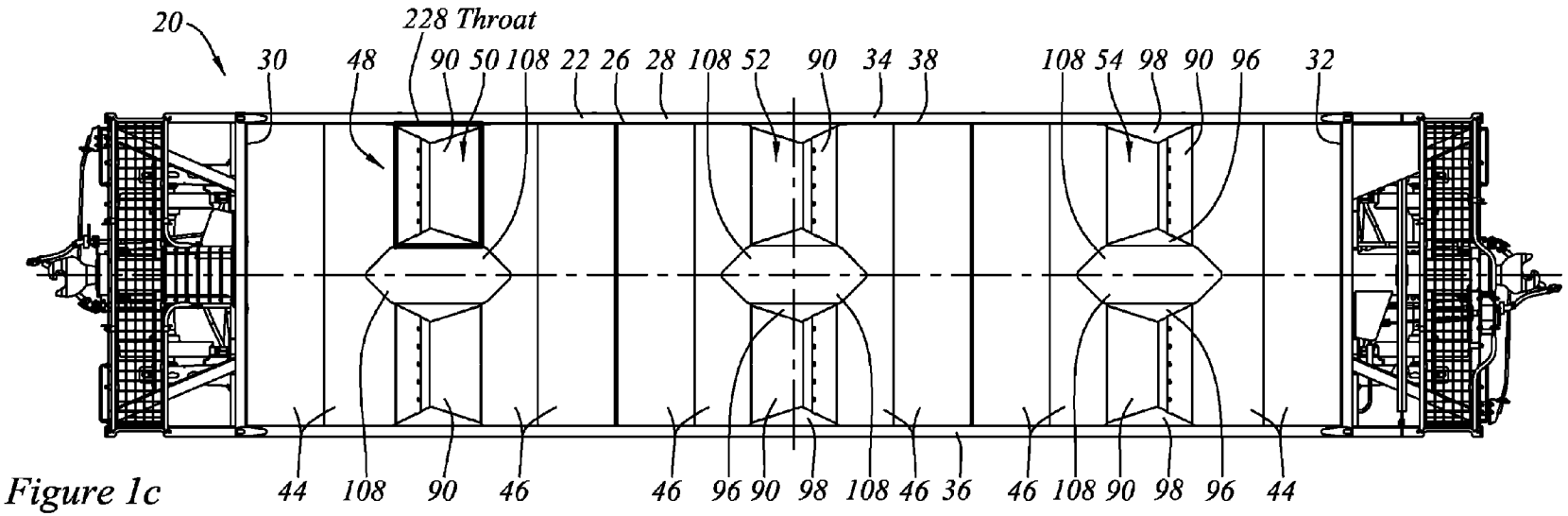
FIG. 1*c* is a top view of the rail road freight car of FIG. 1*a;*
Figure 1B:
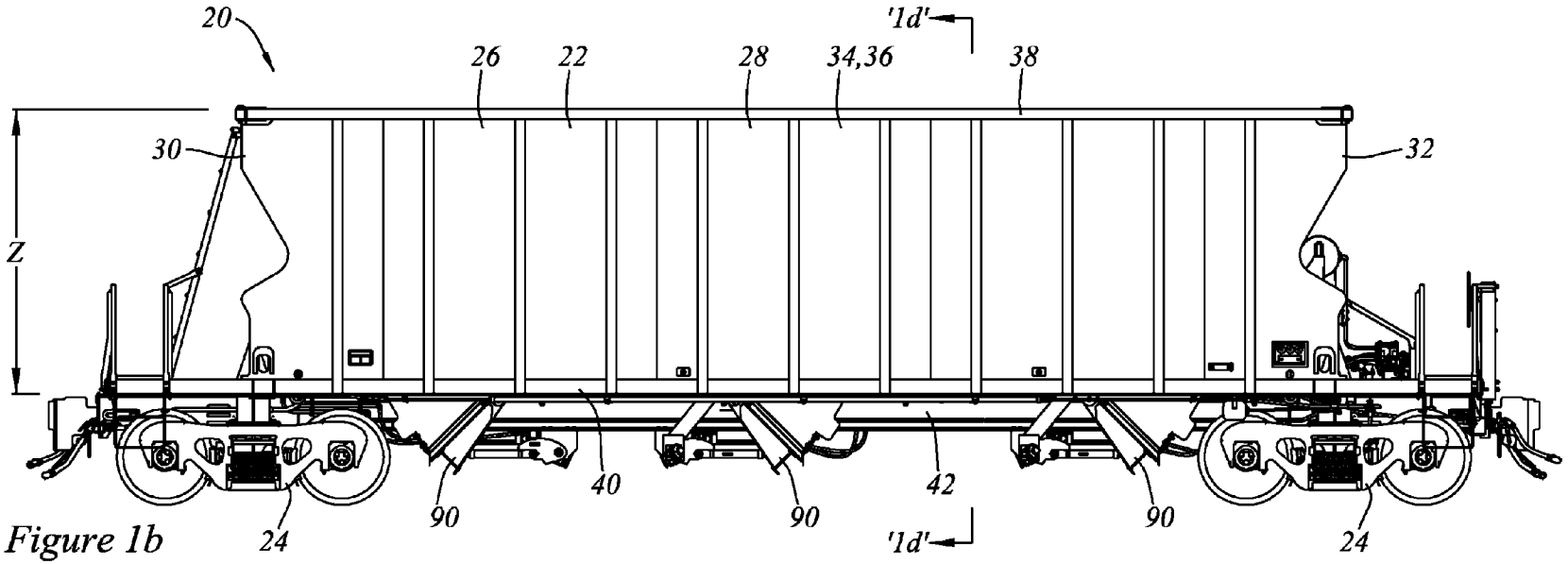
FIG. 1*b* is a side view of the rail road freight car of FIG. 1*a;*

As shown in FIG. 1*c*, the interior of car body 22 may include end slope sheets 44 and lateral partitions such as may be identified as intermediate slope sheets 46 that may extend between the sidewalls of the car, in a manner such as may tend to divide the internal space 48 of car body 22 into two or more sub-compartments, sub-volumes or subspaces indicated generally as 50, 52 and 54 in this example, and which may be referred to as hoppers. Clearly, in some embodiments there may be one single hopper, in others two hoppers and in others three, four, or more hoppers. As may be noted, end sheets 44 may be slope sheets, and internal partition sheets 46 may also be slope sheets. Not atypically, each pair of fore-and aft opposed slope sheets, be they end sheets or internal partitions, may be inclined at equal and opposite angles, and the angles of those sheets may be selected to be somewhat steeper than the free slope angle, or natural angle of repose of the lading for which the car is designed, such that, when the gates are opened, the lading may tend to flow out, rather than sit at rest.

Car 20 may have relatively large slope sheets, be they 44 or 46, which may tend to extend to a height relatively close to top chords 38. That is, taking either the coupler centerline height or the center sill cover plate upper surface as a datum, slope sheets 46 may terminate at a height that is at least half way to top chord 38, and which may, in some embodiments, extend more than ⅔, ¾ or ⅘ of that distance, as may be.

Car 20 may include a fitting 60 mounted at the apex where two adjacent slope sheets 46 meet. Fitting 60 may be termed a partition, or a divider, or a reinforcement. Although any of those terms may be used, fitting 60 may be referred to as a ridge plate.

Figure 1D:
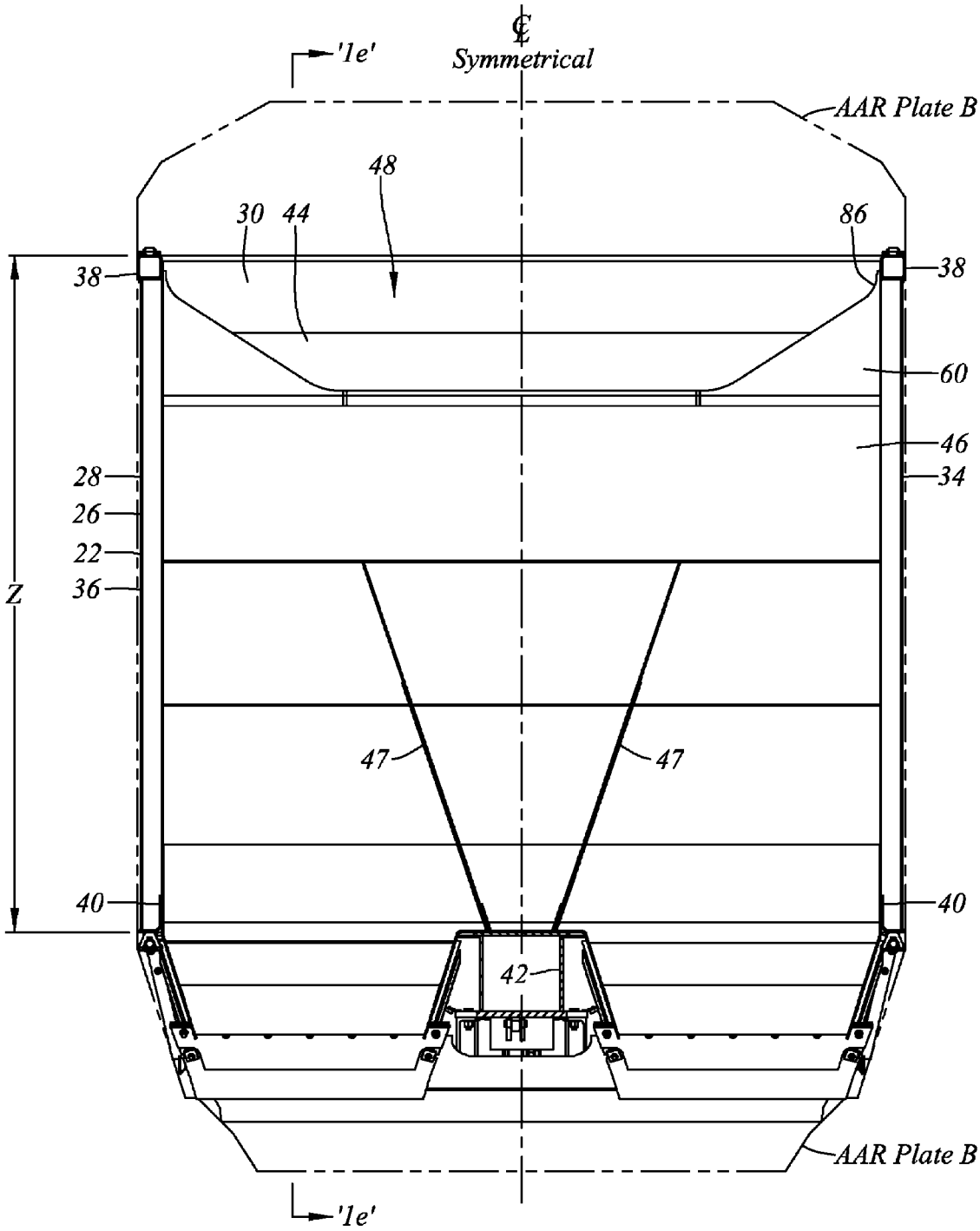
FIG. 1*d* is lateral cross-section of the rail road freight car of FIG. 1*a*, taken on section '1*d*-1*d*' of FIG. 1*b;*
Figure 1E:
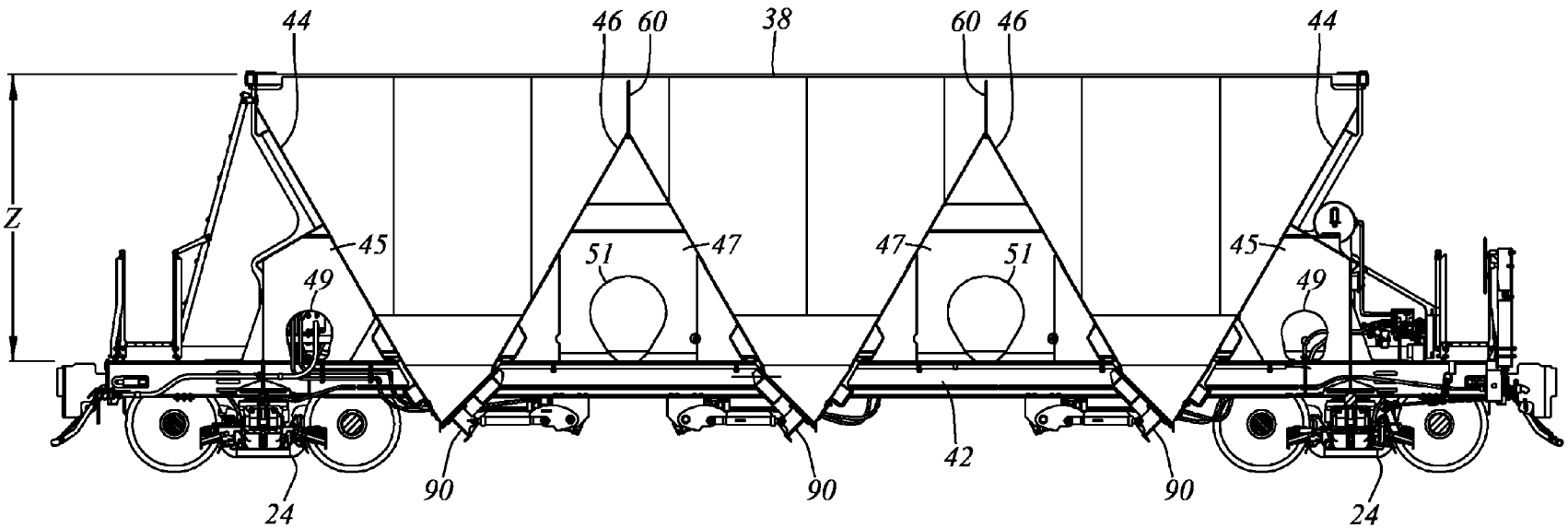
FIG. 1*e* is a longitudinal cross-section of the rail road freight car of FIG. 1*a*, taken on section '1*e*-1*e*' of FIG. 1*d;*

Slope sheets 44 and 46 may have relatively large spans. So that the spans might not be unsupported, car 20 may include intermediate shear web panels 45 (associated with end slope sheets 44) and 47 (associated with intermediate slope sheets 46) that may extend amidst the otherwise unsupported span and provide a link to center sill 42. Pairs of panels 45 and 47 may be laterally outwardly splayed with respect to one another as seen, for example, in FIG. 1*d*. Panels 45 and 47 may include lightening apertures as indicated at 49 and 51.

Figure 2B:
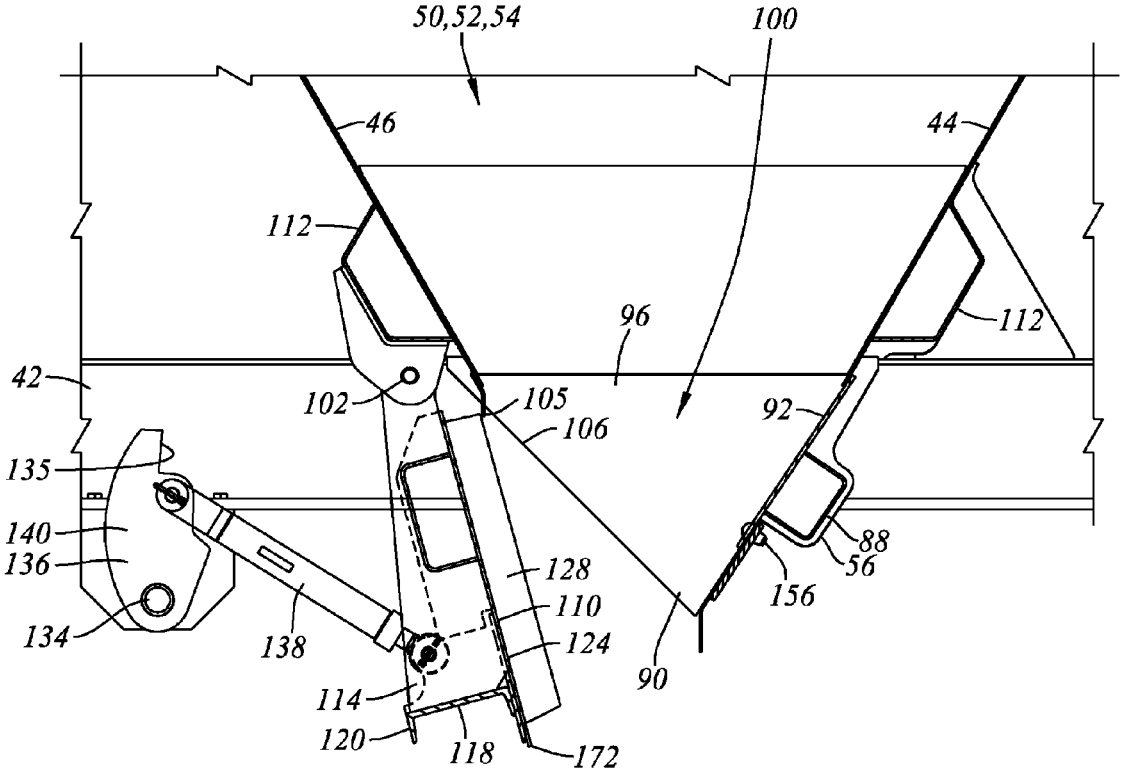
FIG. 2*b* is a view similar to FIG. 2*a*, but with the gate in an open condition.
Figure 2A:
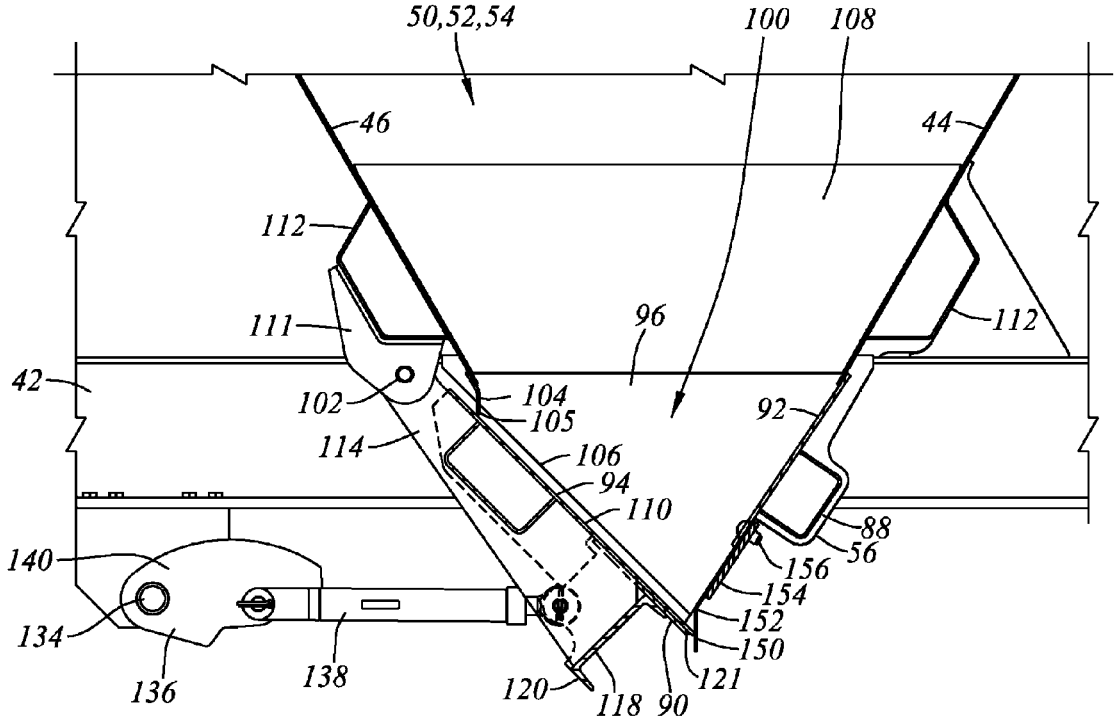
FIG. 2*a* is an enlarged detail of the side view of FIG. 1*a*, showing a hopper discharge assembly with a gate in a closed position.

The lower regions of car body 22 may include gate or discharge assemblies 90, for the various hoppers, however many there may be, by which one or more members that are movable between closed and open positions may be used as a flow control to govern the egress of lading from that hopper. Referring to FIG. 2*a*, the discharge assemblies 90 may include the lower portion of, or a continuation of, one or both of the fore-and-aft slope sheets defining the fore and aft walls of that hopper. For example, hopper 50 (it being chosen arbitrarily, and generically) may include a first fore-and-aft hopper slope sheet extension 92, mounted to one slope sheet, e.g., item 44, and a second fore-and-aft slope sheet extension 94 mounted to an opposed slope sheet, e.g., be it item 46.

Discharge assemblies 90 may also include a pair of opposed side sheet members, 96, 98. Side sheet members 96, 98 may be steel plates, and may be positioned to co-operate with slope sheet extension 92 to define a converging, or funnel-like passageway, or conduit, leading to an opening, indicated generally as 100, at which an exit, or port, or gate, however it may be termed, is defined. In particular, the sides of the periphery of discharge opening 100 may be defined by the margins 106 of side sheet members 96 and 98 that angle upwardly and away from slope sheet extension 92. The bottom edge, or sill, of the discharge opening may be defined by the lowest margin or extremity of slope sheet extension 92, or such fittings or assemblies as may be mounted thereto, as may be described hereinbelow. The term "throat" may be used in this first context of margins 106 and the bottom edge of extension 92, and also in a second context, namely of the rectangular opening or entrance or inlet to the discharge section, roughly, in a horizontal plane at the level of the juncture of the center sill shroud 108 with the check plate (i.e., side sheet member 96). The term "throat" when used in this document, including the claims hereof, will be understood to refer to this second context unless otherwise noted. First slope sheet extension 92 may be a panel that is rigidly fixed relative to the first slope sheet, and may be made from a metal, such as a steel, that may serve as a wear plate, and which may be hardened or alloyed for such a purpose. Slope sheet extension 92 may be reinforced along its lower lateral margin by a lip stiffening member 88, which may be a U-pressing, or channel, mounted to the outside face of extension 92 and forming a hollow section therewith, capped by the wings, or tabs 56 of side sheet members 96, 98.

Slope sheet extension 94 may be a movable slope sheet extension, and may be, or may be part of, a moveable closure member or closure assembly, or door assembly, that is mounted to move between a closed position (FIGS. 2*a*, 3*b*, 4*b*, 5*b*, 6*b*) obstructing flow through throat 100, and an open position (FIG. 2*b*, 3*c*, 4*c*, 5*c*, 6*c*) in which flow through throat 100 is less obstructed, such that lading may be discharged. To that end, slope sheet extension 94 may be connected to the rest of body 22 at a hinged or pivoted member, such as a pivot pin or hinge 102, such as may tend to constrain slope sheet extension 94 to a single degree of motion relative to opening 100, which, in one embodiment, may be angular displacement (i.e., rocking or pivoting motion, about an axis, such as the axis of hinge 102). Slope sheet extension 94 may also be referred to as a door pan. By virtue of its motion, slope sheet extension 94 may be considered to be, or to be part of, a door or door assembly, or closure, or closure assembly such as may be referred to generally as 110. A shroud 104, which may be flexible, may be mounted along the nether edge of the slope sheet, be it 44 or 46, and may have a depending margin 105 that engages the upper laterally extending margin of extension 94. Shroud 104 may be biased to maintain contact with extension 94 and may be mounted to the underside of sheet 44 or 46.

Where car 20 includes a straight through center sill, such as item 42, rather than having a single full width hopper discharge assembly 90, such as might tend to be centered on the longitudinal centerline of the car, there may be two such discharge assemblies 90, one mounted to either side of center sill 42, in car 20. In this latter case, the center sill may tend to be protected from abrasion or other damage by one or more shrouds 108. Shroud 108 may, in cross-section, have the form of an inverted V, whose arms may extend on an incline upwardly from the upper, laterally inboard margin of inboard side sheet members 96, to meet at an apex above center sill 42 along the centerline of the car.

Figure 2C:
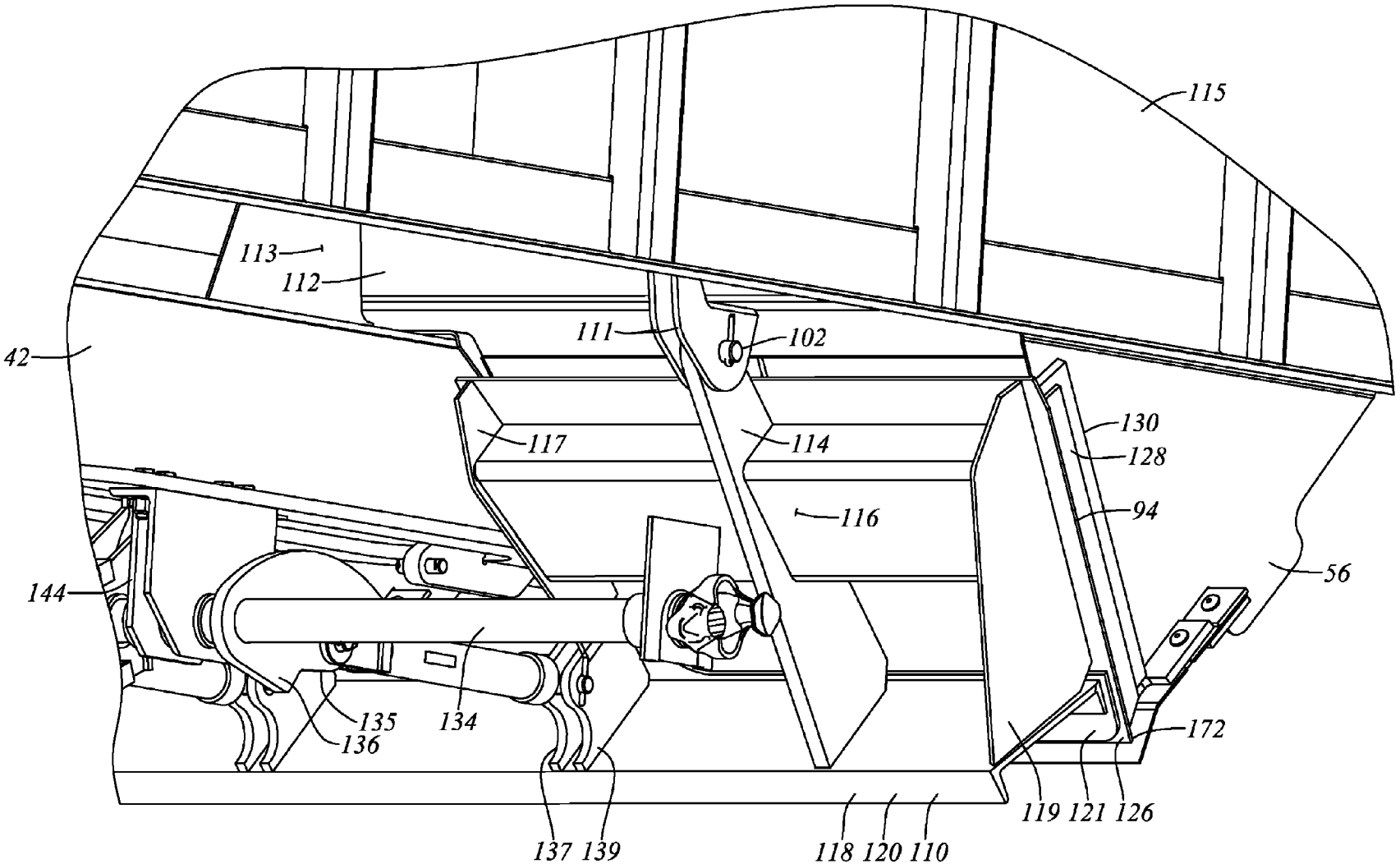
FIG. 2*c* shows a rear perspective view of a movable closure member of the gate of FIG. 2*b* under construction with side sill and outboard side sheet removed.

Considering now door assembly 110, as a preliminary matter it may be noted that the lower laterally running margins of the slope sheets, be they items 44 or 46, may be reinforced by a lateral margin reinforcement member, 112. Member 112 may be such as to have, or to cooperate with, the respective slope sheet to yield, a closed periphery hollow section, i.e., a hollow tube, that may be capped inboard by a web 113, and outboard by side sheet 115 (FIG. 2*c*) of the hopper (whichever it may be), thus providing a shear web to discourage deformation of the tube section. The tube so created may tend to add an aspect of robustness to the structure, and may tend to discourage dimensional distortion along the margin, and hence along the hinge and along the slope sheet extensions, as may be. In one embodiment, member 112 may be a generally channel shaped U-pressing, which may have somewhat splayed legs, the toes of the legs being mounted against, and welded to, the slope sheet, and the back standing outwardly therefrom.

Door assembly 110 may include motion accommodating, or motion permitting, fittings, such as hinge 102. Hinge 102 may be received in a pivoting arm member, 114 which, itself may nest between webs 111 defining a clevis. Arm member 114 may run along the back of the door pan sheet, or wing, defined by extension 94. Arm member 114 may extend generally radially away from hinge 102 toward the distal margin of extension 94, and may be a substantially planar member lying in a plane perpendicular to the axis of hinge 102. Given that hopper doors seem to be prone to abuse in service, extension sheet 94 may have a laterally extending reinforcement 116 that may run across the back of extension 94, not overly far from hinge 102. Reinforcement 116 may have, or may co-operate with extension 94 to define, a hollow structural section, which may include either internal shear webs, (one of which may be defined by the body of pivoting arm member 114 itself), or end caps defined by the inboard and outboard stiffeners 117, 119 of door assembly 110. Reinforcement 116 may have the general form of a channel having toes welded to extension 94, and may be a U-pressing. Door assembly 110 may be reinforced along the distal edge of the door by yet another lateral reinforcement member 118. In one embodiment, member 118 may have the form of a channel section 120, which may be mounted with one leg welded flat to the back of sheet 94, quite near the distal margin of extension 94. Once again, member 118 may provide a certain robustness of structure, such as may tend to discourage distortion of the distal margin of sheet 94 when the car moves with the door acting as something of an unintentional plow while the discharge section is still obstructed by the lading being discharged. In addition, either extension 94 may be thicker along its distal margin, or a further backing or reinforcement member such as a doubler 121 may be located between channel section 120 and extension 94. Reinforcement member 118 may extend not only across the back of door assembly 110, but also across the back of the adjacent opposite handed door assembly 110 mounted on the opposite side of the car such that the two door assemblies may be yoked together. Door assembly 110 may also include end webs or end gussets, namely stiffeners 117, 119, such as may tend to run predominantly radially along the back of extension 94 near to the predominantly radially extending margins of extension 94.

The front or forward facing surface 124, or face of the panel or door sheet, or pan defined by extension 94, may, in one context, be defined in terms of facing toward the interior of the volume of the hopper, or in a direction facing toward the lading, or toward the opposed members of the hopper discharge assembly in either the closed or the open position. The back or rear face 126 of the door sheet will not tend to face inwardly with respect to the hopper, the lading or the discharge assembly under either the open or closed positions of the door. The front, or upward, or inward facing surface 124, however, will tend, in general, to face inwardly toward the lading. Door assembly 110 may include upstanding lips, or cheeks, or legs, such as side wall members 128, that stand proud of the inwardly facing surface of the door. The root of members 128 may lie directly over the mating webs of the gussets, namely items 117 and 119. When the mating moving and stationary portions of the discharge assembly come together, members 128 may tend to seat against the opposed lateral cheek, rim or lip, such as may be defined by a backing plate, or bar 130 welded to one or the other of items 96, 98.

The door assembly 110 is drivable between open and closed conditions by an operating mechanism, indicated generally as 140. This mechanism may include a driven shaft 134, a crank arm 136, and a link arm 138. The outer end of shaft 134 is supported by support arm 133 depending from cross member 112 of body 22. Link arm 138 may be of adjustable length, typically a device having a left hand thread at one end, and a right hand thread at the other, such that turning the barrel adjusts the length, at which point the device is secured, whether with locknuts, or wired locknuts, or by some other means. In any case, the link arm is adjustable on fit up when the door is installed and assembled. Door arm crank 136 may include an over-center stop 135, such that when crank arm 136 and link arm 138 are moved to an over-center condition, (e.g., when the door is in a closed condition), and lading bears against the door, the crank and link may tend to be forced to a secured, closed position, rather than tending to creep to an open position such as may have a greater tendency to permit lading to leak. The entire arm assembly may be driven by a motive apparatus, which may include a pneumatic ram 142, connected to a crank arm, clevis or double crank arm, 144, and mounted under center sill 42.

In one embodiment, the movable door assemblies 110 of adjacent discharge sections on either side of center sill 42 may be connected to a common shaft 134 driven by the motive apparatus. Double crank arm 144 may be rigidly mounted centrally to shaft 134 and may function as an input lever to provide torque thereto. The output levers, namely crank arms 136, may also be rigidly mounted to shaft 134. The ends of connecting rods or links arms 138 are mounted in a clevis formed in two webs 137, 139, that embrace the inboard rear face reinforcement, item 117, of the door panel namely extension 94 at its junction with the distal reinforcement channel section 120.

A seal or seal assembly 150 may be mounted along the distal edge of slope sheet extension 92. Seal assembly 150 may include a door seal member 152 having one or more fittings, such as through holes, by which member 152 may be attached to slope sheet extension 92. The uppermost, or proximal margin of member 152 may be trapped between extension 92 and another member, which may be a reinforcement or backing, such as a backing plate 154, that may run laterally across the back of extension 92, near the lower margin of extension 92. Fasteners 156, which may be threaded fasteners, or fasteners that involve plastic deformation or clinching, such as Huckbolt® fasteners or rivets, may be used to secure the backing or reinforcement, and hence seal member 152, in place. The fasteners may be pan head fasteners. In general it may be that the design may seek to minimize the extent to which downstream features stand proud of the plane P of extension 92, (i.e., the plane of the discharge slope) such as might otherwise present loci at which particulate may catch and build up rather than slide.

Backing plate 154 may overlap the lower margin of extension 92, such that a proximal portion backs extension 92, and a distal portion extends in an inclined manner generally downward, predominantly in the direction of the slope of extension 92. Distal portion may have (when installed) a lowermost margin, which may also provide a contact for the back, or downward side, of seal member 152.

Seal member 152 may include a first margin, which may be called a proximal margin, that is clamped by backing plate 154 to extension 92. Seal member 152 may also include a first portion, which may be termed a proximal portion, that overlies the backing plate. Seal member 152 may include a second portion, that may be a distal portion, that may be cantilevered beyond lowermost margin of backing plate 154. That second portion may include a land against which the opposing closure member may bear when the moving and stationary parts of the door are brought together. In one embodiment, it may be the most distal, laterally extending margin or lip of door assembly 110 that contacts, and deflects, the land.

Seal member 152, or analogous structure, could be mounted on the moving door member, and the stationary door member could have a lip analogous to lip 172; or alternatively, seal members could be placed on both sides of the closure interface, although this might perhaps seem redundant in some instances. In each of these alternatives, there is relative motion of the moving and stationary portions of the door assembly between open and closed conditions, such that discharge assembly 90 governs the retention and outflow of lading. At the coming together of the door components, mutual engagement of the one with the other causes elastic deflection of an energy storage device. The elastic deflection, may involve flexing a seal member in the manner of flexing a beam, and may include flexing the beam member over a contact, or rocker, or fulcrum. Inasmuch as the flexing may be toward, or may include a component of displacement toward, the lading, or the space that the lading would normally occupy, the introduction of lading into the lading containment structure may tend to result in lading bearing against the flexed seal member, with the tendency to cause that seal member to seal more tightly than otherwise.

Figure 3A:
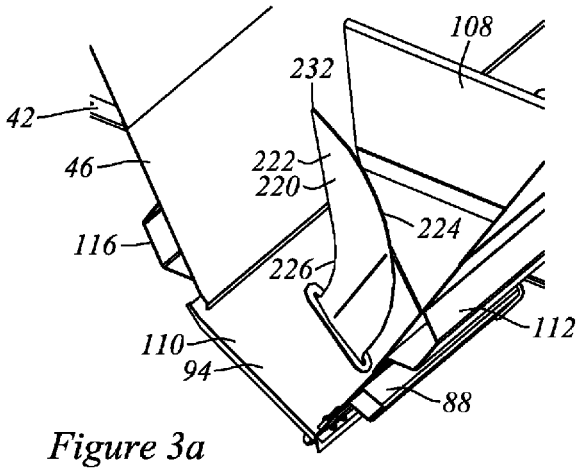
FIG. 3*a* is an isometric detail of a first embodiment of hopper gate for use in the rail road freight car of FIG. 1*a* having a lading dislodgement member.
Figure 3B:
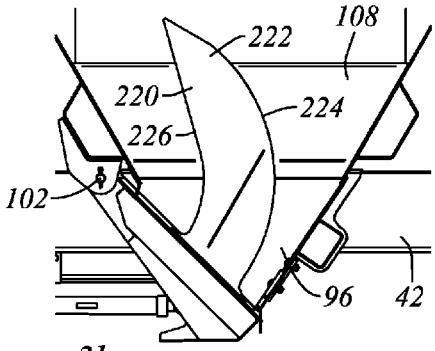
FIG. 3*b* is a side view of the embodiment of FIG. 3*a* in the closed position.
Figure 3C:
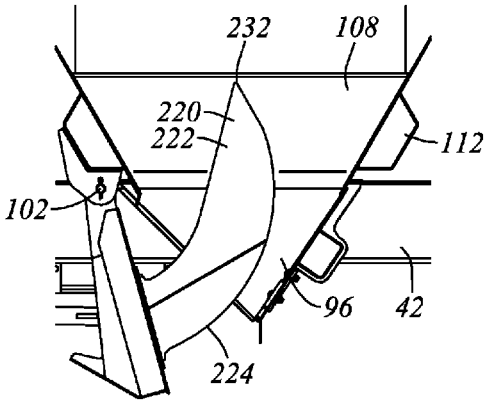
FIG. 3*c* is a side view of the embodiment of FIG. 3*a* in the open position.

Referring now to FIGS. 3*a* to 3*c*, it may be that car 20 is provided with an apparatus or member 220 such as may tend to encourage fine granular particulate, including such fine granular particulate as may be relatively moist, such that it may tend to be relatively sticky to flow out of the hopper when the gate is opened. That is, the lading dislodgement apparatus, or member 220 may tend to discourage the lading, or a portion thereof, from remaining in a jammed or bridging condition in the lower portion of the hopper, such as may be in the general region of the hopper throat.

In one embodiment, the lading dislodgement member 220 may have the form of an arched extension 222. In one embodiment, extension 222 may have an arched shape running from a relatively broad base and tapering to a sharp or pointy tip. Alternatively, extension 222 could be relatively straight (as opposed to curved), and could be tapered. That is, the far or distal edge may have an arcuate or curvaceous profile, as at 224, or the near or proximal edge may have an arcuate or curvaceous profile, as at 226, or, as shown, both profiles may be curved, or arched, however it may be termed. Extension 222 may be mounted to one of the door pans, whether by welding or attachment with mechanical fasteners such as threaded fasteners or Huckbolt® fasteners. Extension 222 may be profile cut from flat plate, such that it may be substantially planar. Extension 222 may be mounted such that the axis of the door hinge is normal to the plane of extension 222. Each door may have a single such extension 222, or may include an array of such extensions, the members of the array being spaced across the width of the door pan (i.e., spaced in the transverse or y-direction). In one embodiment there is an array of two extensions 222, both being welded to the door pans (and aligned with the hinge plate on the opposite side of the door pans). Extension 222 may be mounted in a plane extending predominantly, or entirely, perpendicular to the plane of the door pan. Extension 222 may also be termed a knife, a blade, a tine, a prong, or such other term for a protruding member. Extension member 222 is mounted to the door pans, or panels, and may have its outer profile cut in such a way as not to contact the opposite, non-moving side of the discharge chute during motion between open and closed positions of the door.

In some instances, bridging of fine aggregate over the bottom of the hopper (i.e., the throat) has been observed when the doors are opened. The term bridging refers to the tendency of the fine aggregate, e.g., wet sand, to compact in the wedge defined by the converging walls of the hopper outlet section, and to become lodged sufficiently tightly that it tends to form a self-supporting arch, or bridge. This tendency to bridge may be aided by the settling and vibration during car motion. When the gate is opened, some aggregate may fall out, but the remainder forming the bridge, and anything thereabove, may stay in place. As may be appreciated, manual attempts to dislodge the bridged material, whether by prodding from below, or by working from above may not be advisable. Another known method of dislodging bridged material is to cycle the doors repeatedly, but this may not necessarily be effective. Still another method for dislodging the stuck material is to agitate the entire car in a shaker, or vibrator, or to strike the car externally, as with sledge hammers. However, this rough handling may result in damage to the car, notably to the top chord members. It may be, however, that the proposed device will cause the bridge to break, and allow the commodity to discharge from the car. This would be help to the extent that it may avoid a need to design the car for shaker service, per AAR Recommended Practice RP-200-78. This may tend to save weight and cost. Further, if shakers are not used, the cars (i.e., the top chords) cannot be damaged by the oscillation of the shaker units. Further, to the extent that shaking, hammering, or other steps are reduced or eliminated, this apparatus may tend to reduce unloading time, and may tend to reduce the labour required by the employees at the unloading facilities.

Extensions 222 may have one or another surmounting fitting member 230. The surmounting fitting member may have be of a certain shape, such as may be one of the alternate shapes shown in FIG. 4*c*, 5*c*, or 6*c*. Any of a variety of shapes may be employed. Fitting member 230 may be thought of as a rake, or tine, or finger member that may tend to stand out of (i.e., have members protruding in one or more directions that are not co-planar with) the plane of extension 222 more generally, or put differently, that extend in one or more directions that have a component of direction normal to the plane of extension 222 more generally). As the top members are pulled or drawn through the lading, they may tend to create a discontinuity, thereby tending to break up bridged material, and allowing egress from that hopper in particular and from the car more generally, of any otherwise "stuck" commodity to be aided or urged or encouraged.

It may be that hopper car 20 has an internal design capacity, in one embodiment, of about 2500 $ft^3$. in the level full condition. The inventors believe that the tendency for bridging to occur may vary in proportion to the height of the lading in comparison to the size of the throat at the outlet. The relationship of several dimensional ratios may serve as proxies for this phenomenon.

Figure 2D:
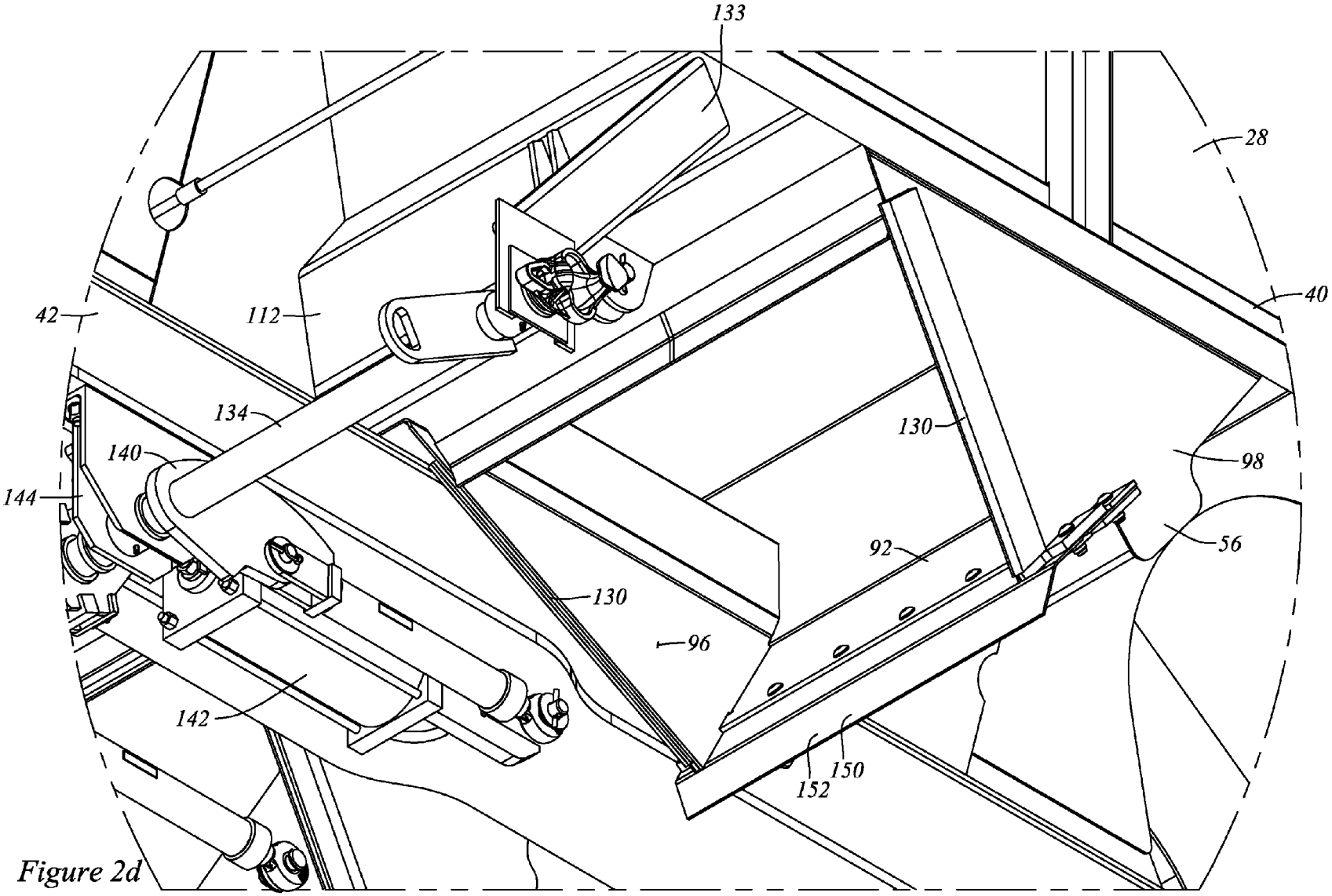
FIG. 2*d* shows an isometric view of the discharge assembly of FIG. 2*a* taken from below, outboard, and behind the door crank, with the movable door removed to reveal the geometry of the hopper discharge throat.
Figure 2E:
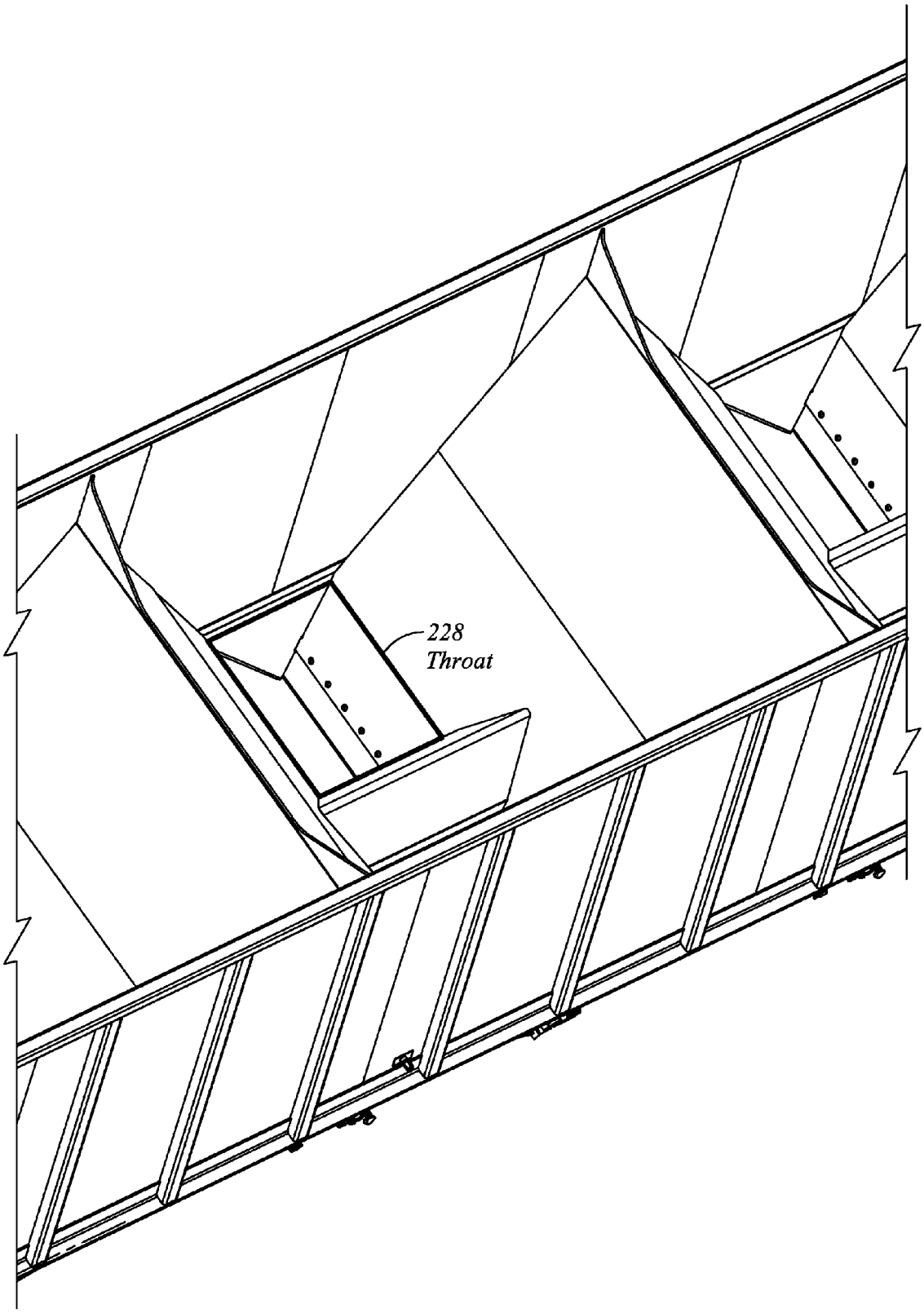
FIG. 2*e* is a view from above showing the hopper discharge throat.

First, in some instances, given that the sides of the discharge do not move, and so therefore sit in a fixed relationship with one another, the spacing of the door hinge from the door sill may be a measure of bridging span. That is, whether covered by a shroud such as member 174 or not, an inch greater spacing of the hinge from the opposite side of the door will imply an inch larger bridging distance. Another measure of characteristic dimension of door opening is the hydraulic diameter of the "throat". As noted above there are several possible alternative definitions of the "throat" be it, for example, the rectangle defined by the hinge, the side edges of the doorjamb, and the lower edge or sill, or the door, or, as shown in FIG. 2*d*. Alternatively, it may be defined as a rectangle 228 whose vertices are in the plane of the break in slope (if such there be) where the lower portion or margin of side sill 40 meets the upper potion or margin of side cheek plate, i.e., sheet member, 98 of the discharge section, which is roughly at the same height as the location at which the center sill hood or shroud 108 gives onto the inboard discharge cheek plate i.e., side sheet 96, which is also at roughly the same height as the discontinuity at the lower margin of the slope sheet 46 where it meets seal member 104. In the discussion that follows, the throat will be taken as being at the second of these alternatives, the throat 228 being, in essence, the upper entrance of the lower, or discharge portion of the hopper. The first definition may not be unrelated to the second definition of "throat". For example, the first definition measures, in essence, the size of the door opening taken normal to the plane of the stationary edges of the door. Where the cheek plates (i.e., sheets 96 and 98) on the sides of the discharge section extend predominantly (or entirely) vertically, that opening is roughly equivalent to, or proportionate to, the projection of the throat taken on the angle of the normal vector of the opening. Thus if the lengths of the side edges are divided by the tangent of the angle of inclination of the opening, and the hydraulic diameter is calculated on the basis of those adjusted lengths, a roughly similar result may tend to be obtained to the result obtained by calculating the hydraulic diameter according to the second definition, as discussed below.

Where the height of the hinge 102 of the door is substantially level with the height of the lower margin of the slope sheet 46 on the door pan side, the height of the plane in which the hydraulic diameter is determined may be taken as the horizontal plane of the hinge axis. Alternatively, where the center sill has a shroud 108 and the bend, or break in slope of the shroud occurs at about the same height as the upper flange of the center sill 42 (should there be one), then the plane of the upper flange of the center sill may be taken as the plane in which the hydraulic diameter is determined. Whichever of these datum points is chosen, (the heights being assumed to be roughly equivalent, and having a measure of approximation in any case), or if a roughly equivalent calculation is made employing the first definition, with the side edges divided by the tangent of the angle of inclination of the edges, the hydraulic diameter $D_H$ of this rectangle is defined as 4 A/P, where A is the area of the rectangle, and P is the perimeter. Taking the height (arbitrarily designated Z) of the side beam between the side sill and the top chord as a proxy for the depth of the lading, and hence of the vertical pressure tending to compact the lading in throat 228, the ratio of side beam height to the hydraulic diameter of the throat may be greater than 6:5. *I.e.*, the height of the side beam may tend to be greater than the hydraulic diameter of the opening. In some embodiments the ratio may be greater than 4:3. When the door is in the closed position, the height of the uppermost portion of dislodgement apparatus 220 may be as high or higher than the top flange of the center sill, and may tend to protrude to a height higher than the uppermost portion of the center sill shroud, if such a shroud is provided. That is, in the closed position, the protruding member may tend to extend past the height of the throat, and, in some embodiments, may tend to extend past that height by a distance that is greater than half the hydraulic diameter $D_H$ of the opening. In some embodiments it may be extend to a height that is as far past the throat height as ⅜ or more than the hydraulic diameter of the throat. In other embodiments, it may extend more than one half, or more then ¾ of the hydraulic diameter beyond the plane of the throat. The angle of the slope sheets may be less than 60 degrees from the horizontal, and may be about 50 degrees.

Considering the alternate embodiments, in the embodiment of FIG. 3*c*, extension 222 may have a form, when viewed from the side, not unlike a sabre, or scimitar, and may terminate at a sharp point 232.

Figure 4A:
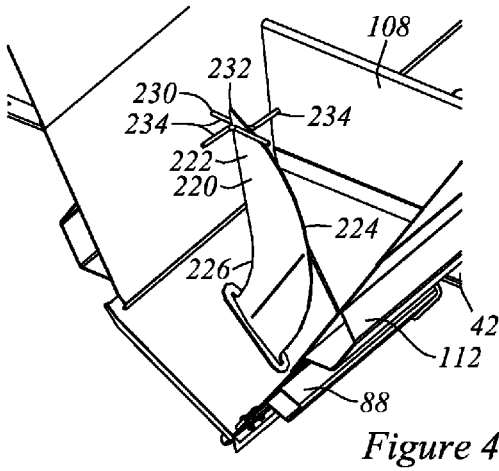
FIG. 4*a* is an isometric detail of a first embodiment of hopper gate for use in the rail road freight car of FIG. 1*a* having a lading dislodgement member.
Figure 4B:
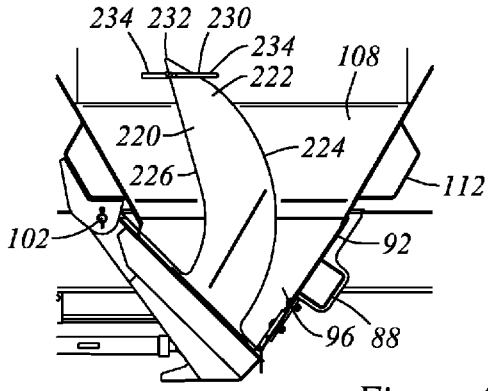
FIG. 4*b* is a side view of the embodiment of FIG. 4*a* in the closed position.
Figure 4C:
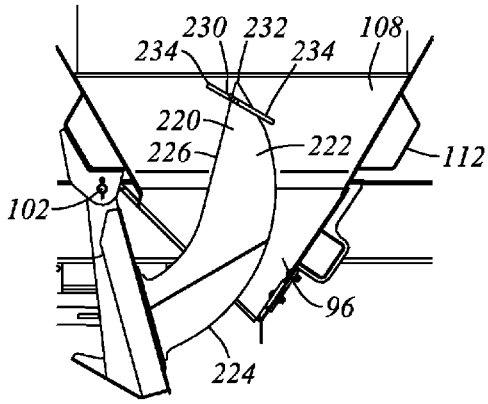
FIG. 4*c* is a side view of the embodiment of FIG. 4*a* in the open position.

In the alternative of FIGS. 4*a*-4*c*, extension 222 may have an array of tines, or blades, or fingers 234 mounted at, or near to, the distal tip thereof. In this embodiment the fingers may be made from round stock, or rod, and welded about the tip. The members may lie in a common plane, which may be horizontal when the door is in the closed position. Each finger may point in a different direction away from the tip, those being fore-and-aft longitudinally, and inboard and outboard transversely.

Figure 5A:
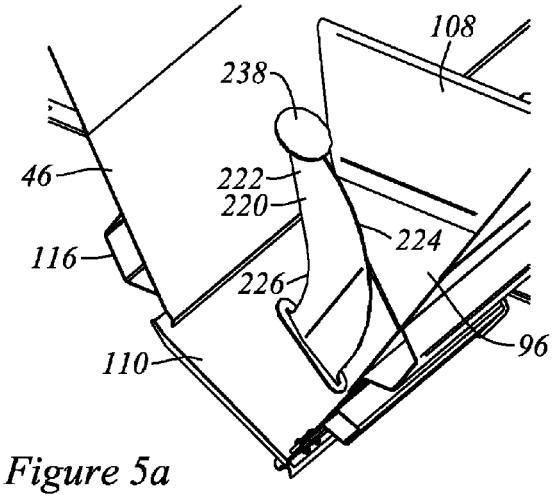
FIG. 5*a* is an isometric detail of a first embodiment of hopper gate for use in the rail road freight car of FIG. 1*a* having a lading dislodgement member.
Figure 5B:
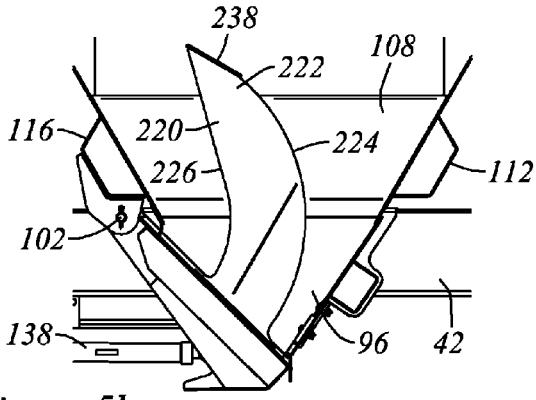
FIG. 5*b* is a side view of the embodiment of FIG. 5*a* in the closed position.
Figure 5C:
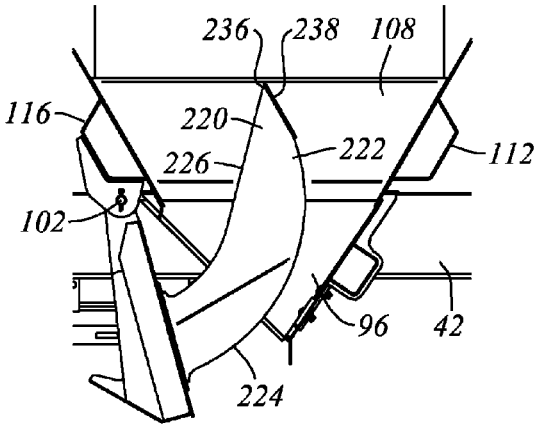
FIG. 5*c* is a side view of the embodiment of FIG. 5*a* in the open position.

In the alternative of FIGS. 5*a* to 5*c*, tip 236 has a plate member 238 mounted to it, as, for example by welding. Plate member 238 may be mounted generally perpendicular to the plane of extension 222. Plate member 238 may be generally round, (or square, or rectangular or triangular, of hexagonal or octagonal, or such other shape as may be suitable), when seen in plan view, and may be welded to the tangent portion of the outer or distal edge profile of extension 222.

Figure 6A:
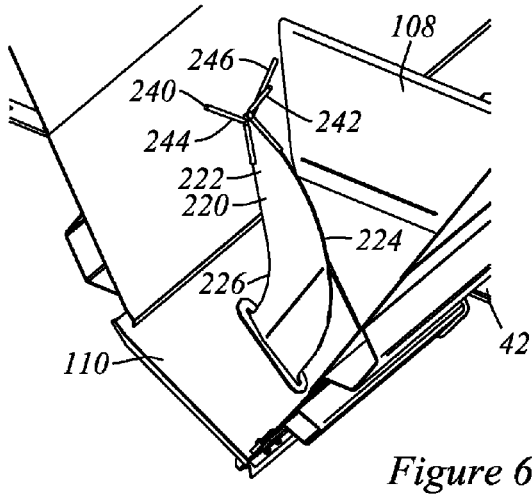
FIG. 6*a* is an isometric detail of a first embodiment of hopper gate for use in the rail road freight car of FIG. 1*a* having a lading dislodgement member.
Figure 6B:
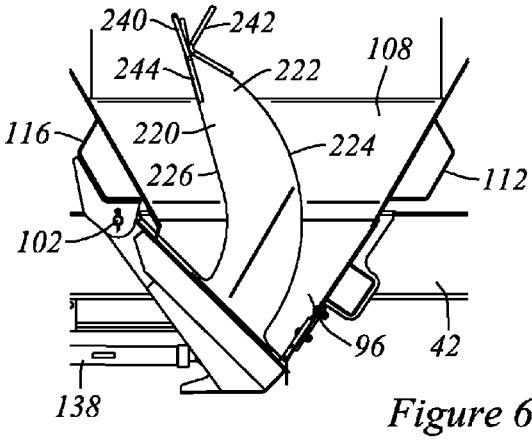
FIG. 6*b* is a side view of the embodiment of FIG. 6*a* in the closed position.
Figure 6C:
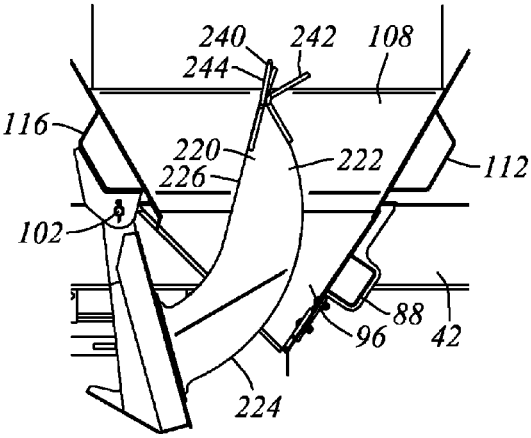
FIG. 6*c* is a side view of the embodiment of FIG. 6*a* in the open position.
Figure 7C:
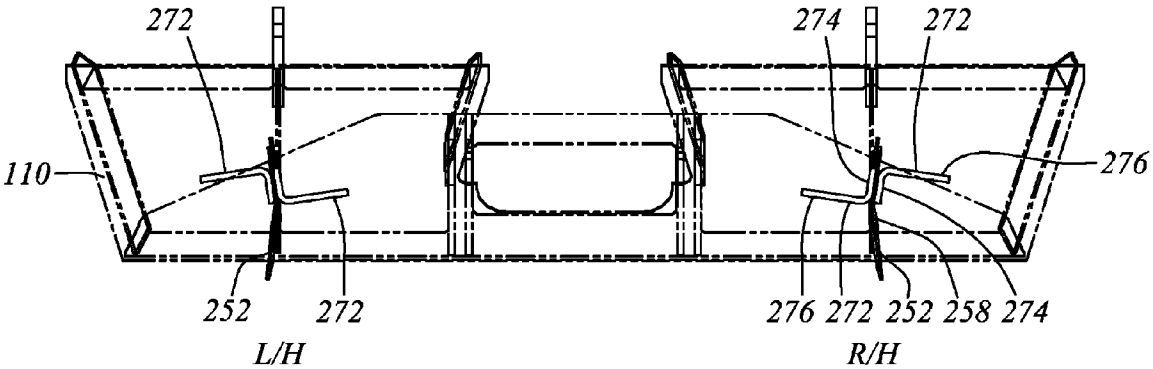
FIG. 7*c* is a view on arrow '7*c*' of the assembly of FIG. 7*a;*
Figure 7B:
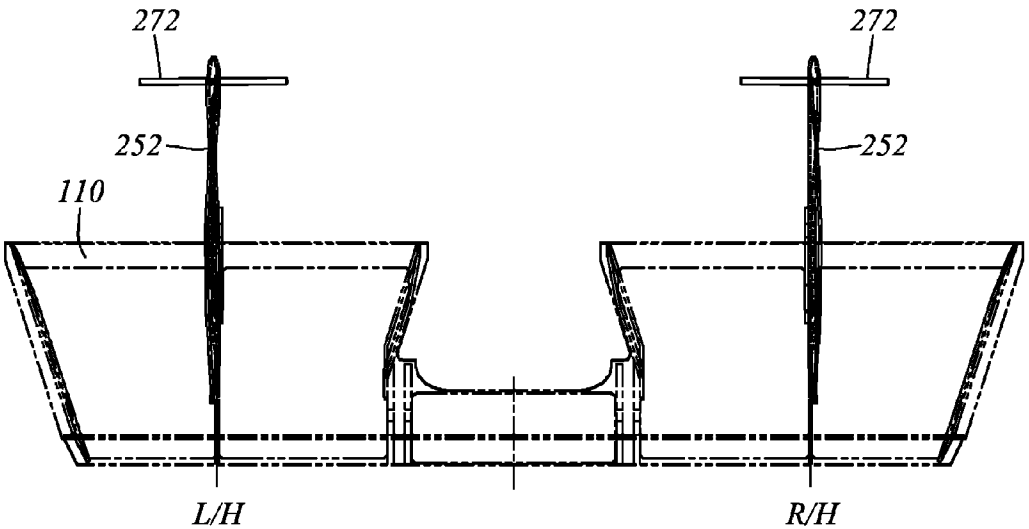
FIG. 7*b* is a view on arrow '7*b*' of the assembly of FIG. 7*a;*
Figure 7A:
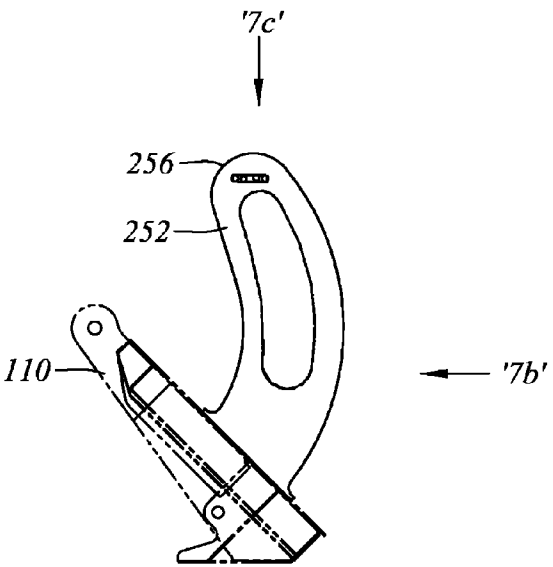
FIG. 7*a* is a side view of a door assembly having an alternate embodiment of lading dislodgement apparatus to that of FIG. 3*a;*

In the alternative of FIGS. 6*a* to 6*c*, tip 236 has an array of tines, or fingers 240. Array 240 may include three members, a first member 242 being a bent rod having a first or root portion welded to the tangent end portion of the outer edge profile of extension 222, and having a bent end the extends partially or predominantly radially outward relative to the hinge axis, a second member 244 having a first or root portion welded along the inner edge of the tip, and having a bent end extending transversely outboard, and a third member 246, being the same as second member 244, but being installed on the opposite hand to item 244.

Further alternative embodiments are shown in FIGS. 7*a*-7*h*. In this series of illustrations door assembly 110 is shown in phantom. Door assembly 110 may have lading dislodgement members or assemblies or apparatus, 252, which may be left and right handed. In one embodiment, apparatus 252 may include an extension member, or wing, or blade, (however it may be termed) 254 that has a generally arcuate shape when viewed from the side as in FIG. 7*a*. The root of blade 254 is mounted to the face of the door pan, typically by welding. The body of the blade extends upwardly and away from the door pan in the generally arcuate manner described above. Rather than tapering to a relatively sharp or pointy tip, blade 254 may have a radiused distal end 256, whose outer radius of curvature is of generally comparable magnitude to half of the root width of blade 254 at the attachment to the door pan. Blade 254 may be substantially planar. Alternatively, blade 254 may have a bend. That is, when sectioned, blade 254 may have a bent shape. The bend may be on a continuous arc, or may be formed on a break line, or crease, as at 258, such that blade 254 has a first generally planar portion 260 and a second planar portion 262 the two planes meeting at the bend line, 258. The angle of the break, or bend, may not necessarily be unduly great. It may be in the range of 10 to 30 degrees, or more narrowly 15-20 degrees, or in one embodiment, about 17 degrees (i.e., such that the included angle between the wings or planar portions is 163 degrees). It follows that blade 254 has an out-of-plane component. That is, the hinge members of the door may sweep through a plane extending radially from the hinge axis, and to which by definition the hinge axis is normal. The normal vectors of at least one of either portion 260 or portion 262 (or possibly both) may be skewed with respect to the normal vector defined by the hinge axis. When the door is in the closed position, the crease line 258 may tend to be substantially vertical, and the end of the crease may tend to meet the outer curve of the profile at or near the most vertically upward point of blade 258. The other end of the crease line may intersect the bottom edge at roughly its middle. Tapering, or pointy blades, such as member 220, described above, in whichever embodiment, may also be provided with one or more apertures.

In the alternate embodiment of FIG. 7*f*, apparatus 252 may have the form of blade 264. Blade 264 is substantially the same as blade 254, although of opposite hand, except insofar as blade 264 includes a generally elongate aperture 266 formed therethrough, aperture 266 having a shape that follows the arcuate shape of blade 264 more generally, and runs perhaps ½ to ¾ of the length of the blade, and be centered more than half way along the arc or length of the blade. The aperture may be generally centered in the width of metal (the blades may be steel or aluminum, for example) such that the resulting strip of metal forms a peripheral loop of roughly constant strip width.

Whether employing a blade on the pattern of blade 254 (l/h or r/h) or blade 264 (l/h or r/h), that blade may be employed without further features, as shown in FIGS. 7*e* and 7*f* respectively. However, in the alternate embodiments of FIGS. 7*d*, each of blades 254 and 264 has a further member 270 such as may be in the nature of an out-of-plane, cross-wise extending rake, or finger, or fork, or branch, or tine or cross-wise extending arm, or arms, 272. (While both members 254 and 264 are shown, this is for illustration. In general one would expect both member to be the same, i.e., a pair of members 254 (l/h and r/h) or a pair of members 264 (l/h and r/h), rather than both). Arm 272 may be a bent rod having a first leg 274 mounted (e.g., as by welding) to the distal portion of the blade (be it 254 or 264) near the tip, and a second leg 276 standing to some extent, or predominantly, cross-wise outwardly therefrom. In one embodiment leg 276 may stand substantially perpendicularly to that portion of blade 254 (or 264 as may be) to which leg 274 is attached. Leg 276 may be skewed relative to the hinge axis of the door. The prongs thus defined may extend outward a distance to either side that is of comparable magnitude to the through thickness o the blades from its inner arc to its outer arc (comparable to twice the radius of curvature of the end of the blade) and may extend, for example, perhaps 3-12, or 4-9 inches to either side (i.e., the overall span being double that width) of the blade.

In operation, the vibrational packing or settling of the lading that may occur during transit may tend to yield a compacted region in the discharge section. That compacted lading may be tightly packed about member 254 (or about and through member 264, as may be). The non-planar shape, the aperture (in the case of item 264) and the end rake, may all tend to increase the rooting of blade 254 (or 264) in the compacted lading, such that when the doors are opened, the blade may tend to be effective in making a break out region amidst the lading in the throat. This breakout may tend to prevent or discourage bridging, or disrupt that bridging in a manner such as may tend to aid in encouraging the lading to flow out the discharge opening.

Various embodiments have been described in detail. Since changes in and or additions to the above-described examples may be made without departing from the nature, spirit or scope of the invention, the invention is not to be limited to those details.

We claim:

1. A rail road hopper car having a receptacle for lading carried by rail road car trucks, said receptacle for lading having at least one hopper discharge, said discharge defining a discharge outlet; said receptacle for lading having a depth Z; said discharge having a throat, said throat having an hydraulic diameter, $D_H$, Z being greater in magnitude than $D_H$; egress of lading from said discharge outlet being controlled by a door, said door having a door panel movable relative to said discharge outlet to a closed position to obstruct passage of lading through said discharge; said door having a lading dislodgement apparatus mounted thereto and being moved relative to said discharge outlet when said door panel moves relative to said discharge outlet; in said closed position of said door said lading dislodgement apparatus extending upwardly and away from said door panel within said hopper discharge beyond said throat; and any one of (a) in said closed position of said door, said lading dislodgement apparatus extends upwardly beyond said throat a distance greater than one half of said hydraulic diameter; and (b) said discharge outlet has a stationary opening, said stationary opening has side edges, each side edge has a length, said door panel mates with said stationary opening, and said lading dislodgement apparatus having a distal portion extending a distance away from said door panel, said distance having a greater magnitude than said side edge length.

2. The rail road hopper car of claim 1 wherein said dislodgement apparatus is a member mounted substantially perpendicularly to said door panel.

3. The rail road hopper car of claim 1 wherein said dislodgement apparatus has an end distant from said door panel, and said distant end has a pointed tip.

4. The rail road hopper car of claim 3 wherein a cross-wise member is mounted at said distant end of said dislodgement apparatus.

5. The rail road hopper car of claim 4 wherein said cross-wise member includes at least one tine.

6. The rail road hopper car of claim 4 wherein said cross-wise member is a plate.

7. The rail road hopper car of claim 1 wherein said dislodgement apparatus has an end distant from said door panel, and said distant end has an array of fingers mounted thereto.

8. The rail road hopper car of claim 1 wherein said lading dislodgement apparatus extends a distance greater than ¾ of said hydraulic diameter upwardly beyond said throat.

9. A rail road hopper car having:

a car body carried on trucks for rolling motion along rail road tracks;

said car body including an upstanding peripheral wall structure for containing particulate lading, and a straight through center sill;

said car body including at least a first hopper and a second hopper, each of said first and second hoppers having first and second sloped side sheets and first and second sloped end sheets co-operably mounted to define an inverted truncated pyramidal funnel;

at least said first hopper having twin first and second discharge sections lying to each side of said center sill, each said discharge section having a throat and a respective discharge door, said respective discharge doors being yoked together for common movement, and being operable to move between open and closed positions to govern discharge of particulate lading from said first hopper;

each of said discharge doors having a movable door panel, and a protruding lading dislodgement prong member mounted to said door panel, said prong member extending generally upwardly of said door panel and inwardly relative to said first hopper; and when said doors are in their respective closed positions, each said prong member having an uppermost extremity, said uppermost extremity being located at a height corresponding to that of said throat.

10. The rail road hopper car of claim 9 wherein said lading dislodgement prong member has a cross-wise member mounted at said uppermost extremity.

11. The rail road hopper car of claim 9 wherein said center sill includes an upper flange and a lower flange, and, when its respective door is in the closed position, said uppermost extremity of said lading dislodgement prong member is located at a height that corresponds to that of said upper flange of said center sill.

12. The rail road hopper car of claim 9 wherein said prong member includes a substantially planar member extending away from said door panel, and an out-of-plane member mounted at said uppermost extremity.

13. A rail road hopper car including a hopper discharge and a door assembly for that hopper discharge, said door assembly having a door panel, a hinge connection by which to mount said door assembly to a rail road car, and a protruding member;

said door panel being movable to a closed position relative to the hopper discharge to obstruct egress of lading from the hopper discharge;

said door panel having an inside and an outside;

said protruding member being mounted to said inside of said door panel; and said protruding member extending from said door panel inside said hopper discharge and upwardly of said hinge connection when said door panel is mounted to the rail road car;

said hopper discharge has a throat, and said throat has an hydraulic diameter; and in said closed position of said door panel, said protruding member extends upwardly beyond said throat a distance greater than one half of said hydraulic diameter.

14. A rail road hopper car including a hopper discharge and a door assembly for that hopper discharge, said door assembly having a door panel, a hinge connection by which to mount said door assembly to a rail road car, and a protruding member;

said door panel being movable to a closed position relative to the hopper discharge to obstruct egress of lading from the hopper discharge;

said door panel having an inside and an outside;

said protruding member being mounted to said inside of said door panel; and said protruding member extending from said door panel inside said hopper discharge and upwardly of said hinge connection when said door panel is mounted to the rail road car;

said door panel mates with a stationary opening, said stationary opening having side edges, each side edge having a length, and said protruding member has a distal portion extending a distance away from said door panel, said distance having a greater magnitude than said side edge length.

15. A rail road hopper car having a center sill, and including a hopper discharge and a door assembly for that hopper discharge, said door assembly having a door panel, a hinge connection by which to mount said door assembly to a rail road car, and a protruding member;

said door panel being movable to a closed position relative to the hopper discharge to obstruct egress of lading from the hopper discharge;

said door panel having an inside and an outside;

said protruding member being mounted to said inside of said door panel; and said protruding member extending from said door panel inside said hopper discharge and upwardly of said hinge connection when said door panel is mounted to the rail road car;

said center sill includes an upper flange and a lower flange, and, when its respective door is in the closed position, each said protruding member having an uppermost extremity, and said uppermost extremity of said protruding member is located at a height that corresponds to that of said upper flange of said center sill.

16. A rail road hopper car including a hopper discharge and a door assembly for that hopper discharge, said door assembly having a door panel, a hinge connection by which to mount said door assembly to a rail road car, and a protruding member;

said door panel being movable to a closed position relative to the hopper discharge to obstruct egress of lading from the hopper discharge;

said door panel having an inside and an outside;

said protruding member being mounted to said inside of said door panel; and said protruding member extending from said door panel inside said hopper discharge and upwardly of said hinge connection when said door panel is mounted to the rail road car;

said protruding member includes a substantially planar member extending away from said door panel, each said protruding member having an uppermost extremity, and an out-of-plane member mounted at said uppermost extremity of said protruding member.

17. The rail road hopper car of claim 13 wherein any one of:

(a) said protruding member is a member mounted substantially perpendicularly to said door panel;

(b) said protruding member has an end distant from said door panel, and said distant end has a pointed tip;

(c) said protruding member has an end distant from said door panel, and has a cross-wise member mounted at said distant end;

(d) said protruding member has an end distant from said door panel, said distant end has a cross-wise member mounted thereat, said cross-wise member including at least one tine;

(e) said protruding member has an end distant from said door panel, a cross- wise member is mounted at said distant end, and said cross-wise member is a plate; and (f) said protruding member has an end distant from said door panel, and said distant end has an array of fingers mounted thereto.

18. The rail road car hopper car of claim 14 wherein any one of:

(a) said protruding member is a member mounted substantially perpendicularly to said door panel;

(b) said protruding member has an end distant from said door panel, and said distant end has a pointed tip;

(c) said protruding member has an end distant from said door panel, and has a cross-wise member mounted at said distant end;

(d) said protruding member has an end distant from said door panel, said distant end has a cross-wise member mounted thereat, said cross-wise member including at least one tine;

(e) said protruding member has an end distant from said door panel, a cross- wise member is mounted at said distant end, and said cross-wise member is a plate; and (f) said protruding member has an end distant from said door panel, and said distant end has an array of fingers mounted thereto.

* * * * *